United States Patent [19]

Parker

[11] 3,955,447

[45] May 11, 1976

[54] PUSH-PULL POWER WRENCH FOR THREADED CONNECTORS

[75] Inventor: Kenneth Wade Parker, Houston, Tex.

[73] Assignee: N-S-W Corporation, Houston, Tex.

[22] Filed: Sept. 17, 1974

[21] Appl. No.: 506,914

[52] U.S. Cl. ..... 81/57.39; 81/57.44

[51] Int. Cl.[2] ..... B25B 13/46

[58] Field of Search ..... 81/57.39, 57.44, 57.16, 81/57.19, 57.22, 57.34, 57.36, 57.46, 52.35, 54

[56] References Cited

UNITED STATES PATENTS

| | | | |
|---|---|---|---|
| 2,972,918 | 2/1961 | Huff et al. | 81/57.44 X |
| 3,706,244 | 12/1972 | Wilmeth | 81/57.39 |
| 3,719,112 | 3/1973 | Kaelon | 81/57.39 |
| 3,745,858 | 7/1973 | Biach | 81/57.39 |

*Primary Examiner*—James L. Jones, Jr.
*Attorney, Agent, or Firm*—Michael P. Breston

[57] ABSTRACT

The push-pull power wrench of this invention includes: a wrench adapter for positioning over a threaded connector desired to rotate, a wrench extending laterally from the adapter, and reaction means positioned on a single anchor point which can be an adjacent connector. A wrench actuator is mounted on the reaction means for exerting a force on the wrench.

11 Claims, 4 Drawing Figures

PUSH-PULL POWER WRENCH FOR THREADED CONNECTORS

REFERENCE TO RELATED APPLICATION

This application is related to copending application Ser. No. 506,915, filed on Sept. 17, 1974, and assigned to the same assignee.

BACKGROUND OF THE INVENTION

Power wrenches for threaded connectors such as nuts and bolts are described in U.S. Pat. Nos. 3,706,244 and 2,972,918. The patented tools are especially adapted for flanges whose threaded connectors are arranged in a circular pattern. There is a need for power wrenches, hereinafter sometimes called "tools," which are especially adapted for use on connectors arranged in a straight line or in non-circular patterns, and which can be selectively operated in push or pull modes.

The torque applied on a threaded connector is, of course, the product of the force and the perpendicular distance from the line of action of the force to the axis of rotation. When using a power wrench, the operator must not exceed a maximum prescribed torque to avoid damaging the threaded connection. The wrench actuator is usually a fluid-operated cylinder having a push rod which engages the wrench at a right angle. By limiting the rotation of the wrench to a small angle in response to a full stroke of the push rod, and by making the right angle to become established at the push rod's mid-stroke, the torque can be fairly accurately measured by measuring only the applied pressure in the cylinder. When a tool is designed for a specific connector pattern, the desired right angle between the line of applied force and moment arm can be built into the tool.

It is a broad object of the present invention to provide a new and improved power wrench which is versatile, which easily adapts itself for use on irregular connector patterns, which can work on threaded connectors the access to which is partially obstructed, and which is relatively inexpensive to manufacture.

SUMMARY OF THE INVENTION

The power wrench of the present invention includes: a wrench adapter for positioning over the connector desired to be loosened or tightened, a wrench extending laterally from the wrench adapter, a socket member for positioning over an anchor member or an adjacent connector, a reaction beam having one of its ends connected to the socket member, and a wrench actuator extending from and in alignment with the reaction beam for exerting a force on the wrench. The actuator has a push rod which couples with the head of the wrench substantially at a right angle.

DETAILED DESCRIPTION OF THE PREFERRED EMBODIMENT

Figure 1:
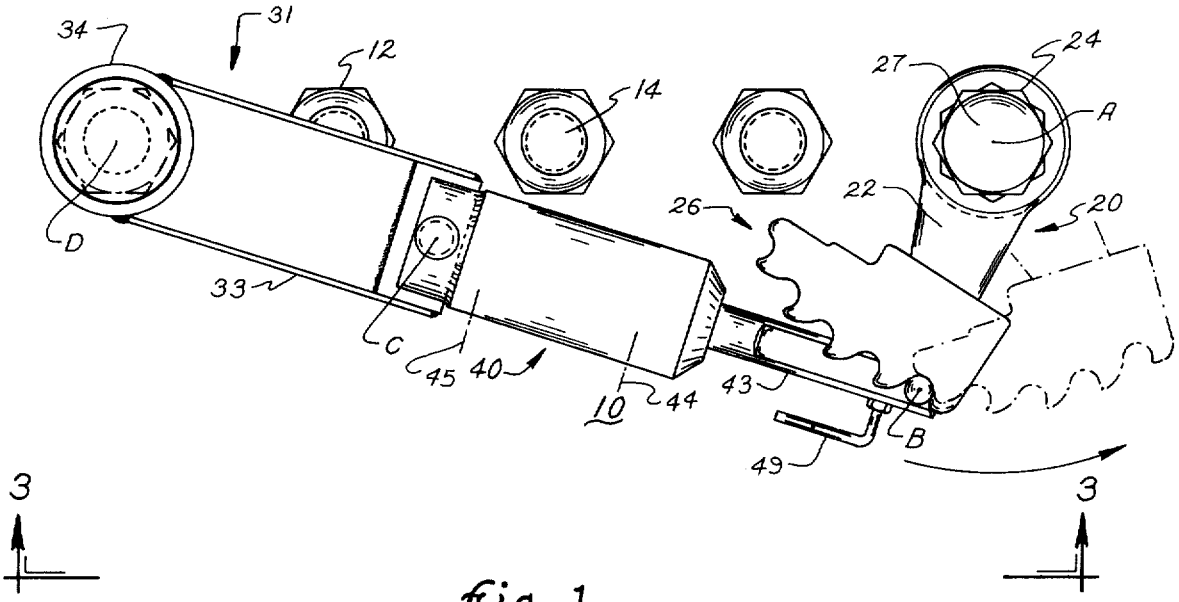
FIG. 1 is a top plane view of the power wrench shown as being positioned for loosening a threaded connector.
Figure 2:
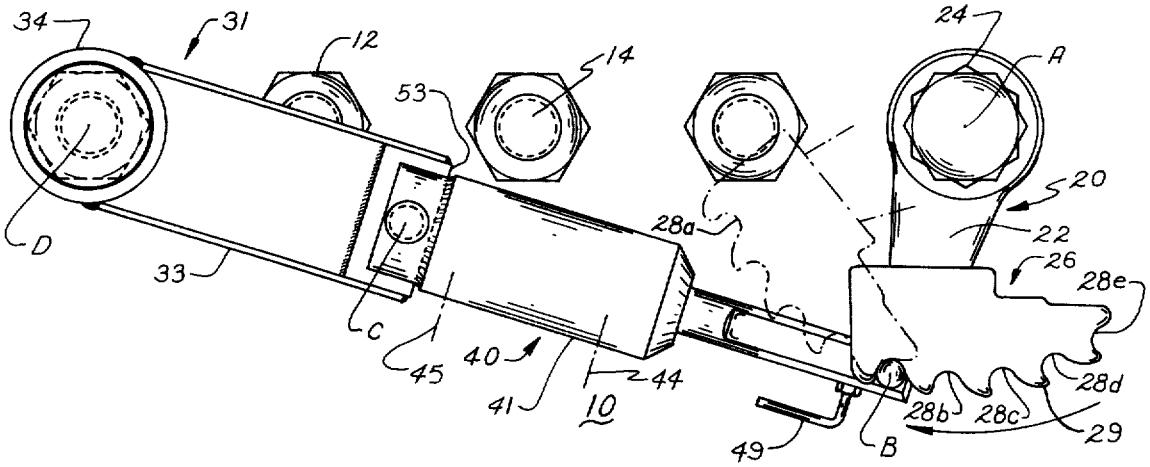
FIG. 2 is a plane view of the tool of FIG. 1 shown positioned for tightening one of the threaded connectors.
Figure 3:
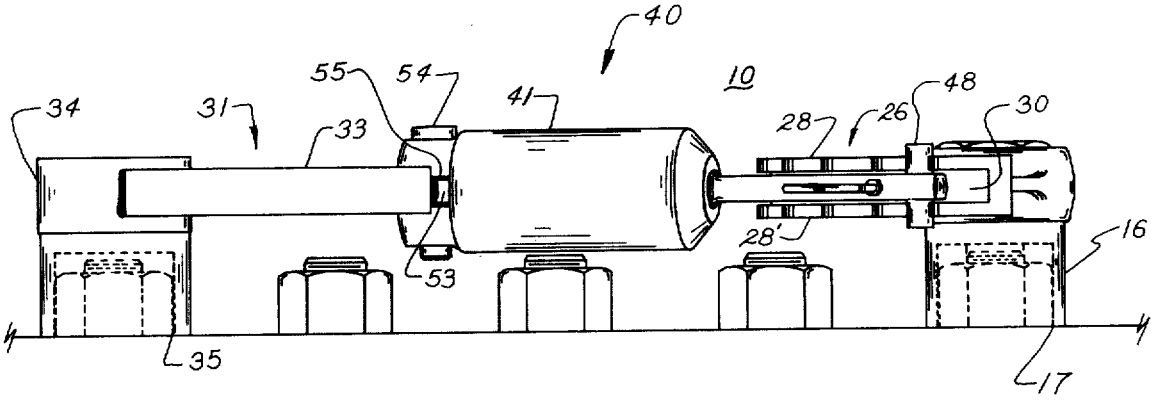
FIG. 3 is a view in elevation of the tool shown in FIG. 1.

Referring now to the drawings, the power wrench shown in FIGS. 1–3 is generally designated as 10. The tool is shown as being positioned over an irregular pattern of nuts 12 threadably connected to bolts 14. To rotate a particular nut, there is provided a cylindrical wrench adapter 16 (FIG. 3) having a coupling means 17, such as a socket, suitable for operatively engaging the threaded connector desired to be rotated. The coupling means 17 can assume various configurations depending on the great variety of threaded connectors which are normally encountered in field use. The length of wrench adapter 16 will depend on the structure containing the threaded connectors and on the kind of obstacles surrounding them. The entire power tool 10 is thus elevated from and hence can work mostly on top of the plane containing the threaded connectors.

To rotate the wrench adapter 16 there is provided a wrench 20 having an arm 22, a socket 24 and a head 26. Socket 24 operatively engages the male hex 27 of the wrench adapter 16. Head 26 has two plates 28, 28' (FIG. 3) which form therebetween a channel 30 of sufficient width to allow the movement therein of a force-producing member. Each outward end of plates 28, 28' is provided with notches **28*a–e* which lie in a common plane and are generally arranged in a circular pattern relative to the axis of rotation of the wrench adapter 16. The ridges 29 of notches 28** are rounded and somewhat inclined to allow the application of force thereto by a cross-pin received in the notches, as will be subsequently described.

Since the application of a pushing or pulling force on the wrench head 26 is accompanied by tension or compression reaction stresses, there is provided a reaction assembly generally designated as 31. The reaction assembly provides a single-point reaction structure and serves as a support for the power means used to produce the force on the wrench head 26. The preferred reaction assembly 31 comprises a reaction beam 33 of any suitable cross-sectional area, although illustrated as being rectangular. Beam 33 is connected at its rear end to an anchor adapter 34 having a socket 35 which loosely fits over an anchor member. This anchor can be another nut 12 which serves as the desired single reaction point.

Figure 4:
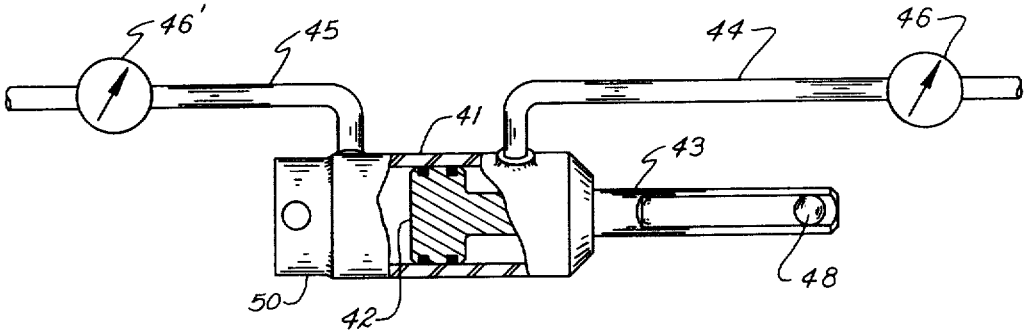
FIG. 4 is a partial schematic showing of the fluid-operated wrench actuator.

The other end of the beam is fixedly coupled to a wrench actuator, generally designated as 40. The actuator may be any power means, although the preferred embodiment of this invention employs a fluid-operated cylinder 41 having a double-acting piston 42 (FIG. 4) from which extends outwardly a push rod 43 that fits inside channel 30 of the wrench head 26. The cylinder is controlled by two lines 44, 45 each adapted to alternatingly receive fluid pressure from a conventional fluid pressure source not shown. The amount of pressure received can be varied to obtain the desired torque value. Suitable pressure gauges 46, 46' in lines 44, 45, respectively, read the applied pressures to the piston 42. Meters 46, 46' are preferably calibrated in units of torque which is possible only if the proportionality factor between the applied pressure and the resultant torque is constant, i.e., only if the line of force is perpendicular to the moment arm, as subsequently described.

The tip of the push rod 43 is provided with a transverse pin 48 having a diameter such that it can freely move into and out of the notches 28*a–e*. A handle 49 allows an operator to grab the push rod. Pin 48 transmits the force generated by the push rod to that ridge 29 which is engaged by pin 48. This force can be a pulling or pushing force. The base 50 of the cylinder is rigidly mounted on a mounting eye 53 adapted to receive pin 54. Eye 53 extends from one end of beam 33 and fits inside a cross-channel 55 in the base 50 of the cylinder. Pin 54 extends through base 50 and through eye 53, as shown in FIG. 3. The anchor adapter 34 is connected, as by welding to the other end of the reaction beam 33. In the power tool 10, beam 33 forms integral part with the anchor adapter 34 for simplicity of construction.

The operation of power tools 10 will be better understood by designating certain critical points of the tool. Accordingly, points A–D respectively designate the centers of wrench adapter 16, pin 48, pin 54, and anchor adapter 34.

OPERATION OF THE PREFERRED EMBODIMENT

It is desired to produce a torque about point A by means of a force applied at B along the line of force BD. Points B, C and D are colinear. The fluid-operated cylinder 41, by means of a controllable fluid pressure, produces the desired force along line BD, which can be a pulling or pushing force. This force is applied at point B and is reacted by an opposite force at D. The reaction force is produced by the reaction beam 33 and is entirely absorbed by the flange or other structure containing the threaded connectors.

The magnitude of the torque produced by the force applied by push rod 43 can be varied by varying the hydraulic pressure in line 47 (FIG. 4) applied against piston 42 in cylinder 41. The accuracy of the torque's measurements provided by gauges 46, 46' is dependent upon the perpendicularity between the line of force BD and the moment arm AB. When power tool 10 is designed, the lengths of AD and AB are selected so that the triangle ABD will be a right triangle when the push rod 43 is at its mid-stroke. Since the deviation of the push rod from its mid-stroke position is kept purposely small by providing a plurality of notches 28, it can be assumed for all practical purposes that the triangle ABD remains a right triangle. In this fashion, maximum torque will be obtained per unit of force.

Loosening Operation

Prior to starting the operation of power tool 10 (FIG. 1), the push rod is contracted and the wrench head 26 assumes the position as indicated by the solid lines. Pressure on line 45 starts the first cycle and causes an extension of the push rod which applies a force along the line of force BD which causes point B to rotate in a counterclockwise direction about point A with a radius AB. For each cycle, i.e., full extension of the push rod, the wrench head 26 will rotate counterclockwise, say 12°, in the direction of the arrow. Pressure on line 44 will end the first cycle by retracting the push rod, causing pin 48 to move down from the first notch 28*a* to the second notch 28*b*. A second extension of the push rod will again cause the wrench head to rotate counterclockwise by 12° and a second retraction of the push rod will move pin 48 down from the second notch 28*b* to the third notch 28*c*. This process is repeated five times until pin 48 falls into the last notch 28*e* and then the wrench head 26 will assume the position as shown by the dotted lines in FIG. 1.

Thus, for five strokes of the piston the wrench head will have rotated counterclockwise by an angle of 60°. If the nut 12 is not sufficiently loosened, then the wrench head 26 is manually returned to its original position, as shown by the solid lines in FIG. 1, and a given number of cycles is repeated to obtain another angular rotation of nut 12. It is of course possible to rotate the wrench head by an angle less than 60°, say 36°, by only executing three full piston strokes instead of five. As thus far described, the power tool 10 has been working in its push mode.

Tightening Operation

In FIG. 2 the wrench head is rotated 180° from its position in FIG. 1 and its initial position is indicated by the solid lines. To operate the power tool 10 in its pull mode (FIG. 2), prior to starting a cycle of operation, pin 48 is made to lie in the first notch 28*a* and the push rod is fully extended. The first cycle of operation is started by applying pressure on line 44 thereby retracting the push rod and pulling on the wrench head 26. In response to the first full retraction of the push rod 43, wrench head 26 will rotate about 12° in a clockwise direction, as shown by the arrow. The first full extension of the push rod will cause pin 48 to move over into the next notch 28*b* thereby completing the first cycle. The second retraction of the push rod will cause the wrench head to again rotate by about 12° in a clockwise direction. After executing five such cycles, the wrench head will have rotated by about 60° in a clockwise direction. Thus, after five complete cycles of rotation the wrench head 26 will assume a position as shown by the dotted lines in FIG. 2. If nut 12 is not sufficiently tightened the process can be repeated, as before, to obtain additional discrete angular rotations of the wrench head 26.

ADVANTAGES OF THE PREFERRED EMBODIMENT

A full reaction point is a point which allows a pull and a push by the reaction means. A half-reaction point allows only a push by the reaction means. Because lines BC and CD are aligned, only a single reaction point is required. In this invention, the single reaction point D can be either a half or full reaction point. When utilizing a full reaction point, the tool can work in a push or pull mode. With the anchor adapter 34, tool 10 can work in either mode.

Because the tool requires only one reaction point, the tool is particularly advantageous for use on the last nut of an irregular pattern of nuts or on a non-reentrant pattern such as a Y pattern or S pattern.

If obstructions exist on one side of the threaded connectors 12, the tool can be positioned mostly on top of the structure containing the threaded connectors, thereby allowing greater versatility in the use of the power tool.

Other advantages and modifications will readily suggest themselves to those skilled in the art and it is desired for all such advantages and modifications to fall within the scope of the claims attached hereto.

I claim:

1. An apparatus for wrenching one of a plurality of threaded connectors, comprising:

a wrench adapter for positioning over one of the connectors, a wrench extending laterally from said wrench adapter, elongate reaction means having a socket member at one end thereof positionable over another of said connectors, said reaction means having its longitudinal center axis extending directly from said socket member center to said wrench, and actuator means extending along said longitudinal axis of said reaction means and being operatively coupled to said wrench for rotating said wrench and said one connector.

2. An apparatus for wrenching one of a plurality of threaded connectors, comprising:

a wrench adapter for positioning over one of the connectors, a wrench extending laterally from said wrench adapter, a single-point reaction assembly comprising:

a socket member positionable over another of said connectors, and an elongate reaction beam coupled to and having its longitudinal center axis extending through the center of said socket member, an actuator mounted on said reaction beam, said actuator extending along said longitudinal axis of said reaction beam and being operatively coupled to said wrench, and means coupled to said actuator for energizing said actuator to thereby rotate said wrench and said one connector.

3. The apparatus of claim 2 wherein said socket member is fixedly coupled to said reaction beam.

4. The apparatus of claim 3 wherein said actuator is a fluid-operated cylinder having one end thereof fixedly secured to said reaction beam.

5. An apparatus for wrenching one of a plurality of threaded connectors, the combination comprising:

a socket member positionable over a single other connector;

a wrench having one end thereof positionable over said one threaded connector;

an elongate reaction beam fixedly coupled to said socket member and having its longitudinal center axis extending from the center of said socket member to said wrench; and actuator means extending along said longitudinal axis of said reaction beam and being coupled between said beam and said wrench for exerting a relative force therebetween.

6. The apparatus of claim 5 wherein said actuator includes:

a hydraulic cylinder having a body portion and an axially slidable piston therein, a rod extending from said piston through one end of said cylinder, said rod having a portion arranged to contact said wrench;

and, the other end of said cylinder being connected to said beam.

7. The apparatus of claim 5 wherein said actuator includes:

a double-acting, cylinder-and-piston assembly, said cylinder having one end thereof connected to said beam and said piston assembly having one end operably coupled to said wrench.

8. The apparatus of claim 7 wherein said wrench at one end thereof has a plurality of spaced-apart notches arranged to receive said one end of said piston assembly.

9. An apparatus for wrenching one of a plurality of threaded connectors, comprising:

a wrench adapter for positioning over one of the connectors, a wrench extending laterally from said wrench adapter, elongate reaction means having a socket member at one end thereof positionable over another of said connectors, said reaction means having its longitudinal center axis extending from said socket member center to said wrench, and actuator means extending along said longitudinal axis of said reaction means and including an elongate force-producing member which is linearly movable relative to said actuator means, said force-producing member being operatively coupled to said wrench for exerting a torque on said wrench.

10. A wrenching apparatus for wrenching connectors arranged in a pattern, comprising:

1. a wrench having one end positionable over one of the connectors and extending laterally therefrom;
2. force-producing-and-anchoring means, including
   a. a linearly-movable, elongate force exerting member coupled to said wrench, and
   b. a socket member positionable over another of said connectors; and said force-exerting member having its longitudinal axis extending directly through the socket member center.

11. The apparatus of claim 1 wherein said wrench is provided at the free end thereof with a plurality of angularly spaced-apart notches which become successively engaged by the actuator means upon actuation thereof.

* * * * *